US011322880B2

(12) United States Patent
Tanaka et al.

(10) Patent No.: US 11,322,880 B2
(45) Date of Patent: May 3, 2022

(54) PACKING MOUNTING STRUCTURE

(71) Applicant: Yazaki Corporation, Tokyo (JP)

(72) Inventors: Yasuhiro Tanaka, Shizuoka (JP); Hiroki Kitagawa, Shizuoka (JP); Masanobu Higashitani, Shizuoka (JP); Kengo Machida, Shizuoka (JP); Maho Shinohara, Shizuoka (JP); Masatoshi Yamada, Shizuoka (JP); Junya Yamamoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/239,978

(22) Filed: Apr. 26, 2021

(65) Prior Publication Data

US 2021/0336376 A1 Oct. 28, 2021

(30) Foreign Application Priority Data

Apr. 27, 2020 (JP) ..... JP2020-078057

(51) Int. Cl.
*H01R 13/52* (2006.01)
*H01R 13/621* (2006.01)

(52) U.S. Cl.
CPC ..... *H01R 13/5202* (2013.01); *H01R 13/5213* (2013.01); *H01R 13/6215* (2013.01)

(58) Field of Classification Search
CPC ..... H01R 13/5202; H01R 13/5213; H01R 13/6215
See application file for complete search history.

(56) References Cited

U.S. PATENT DOCUMENTS

| | | | | |
|---|---|---|---|---|
| 10,135,173 | B2 | 11/2018 | Kashiwada | |
| 2014/0120767 | A1* | 5/2014 | Itsuki | H01R 13/5202 439/587 |
| 2016/0043492 | A1* | 2/2016 | Nakai | H01R 13/4226 439/752 |
| 2019/0190188 | A1* | 6/2019 | Iwabe | H01R 13/5202 |
| 2019/0348797 | A1* | 11/2019 | Shiraishi | H01R 13/6315 |

FOREIGN PATENT DOCUMENTS

JP 2016-225057 A 12/2016

* cited by examiner

*Primary Examiner* — Tho D Ta
(74) *Attorney, Agent, or Firm* — Sughrue Mion, PLLC

(57) ABSTRACT

A packing mounting structure includes a casing having a passage part on a wall part facing a power detection terminal; packing including a seal part and an portion to be held; and a cover installed on the casing in a state in which the portion to be held is held by a hole part, and closing the passage part by the packing. The portion to be held includes a shaft part and a first flange part. The hole part includes a narrow part; an insertion hole part through which the first flange part is capable of passing; and a holding hole part configured to hold the shaft part in a state in which a gap is formed between the holding hole part and the shaft part.

8 Claims, 13 Drawing Sheets

PACKING MOUNTING STRUCTURE

CROSS-REFERENCE TO RELATED APPLICATION(S)

The present application claims priority to and incorporates by reference the entire contents of Japanese Patent Application No. 2020-078057 filed in Japan on Apr. 27, 2020.

BACKGROUND OF THE INVENTION

1. Field of the Invention

The present invention relates to a packing mounting structure.

2. Description of the Related Art

Conventionally, a technology of preventing water from entering a housing by packing, a rubber stopper, or the like has been known. Japanese Patent Application Laid-open No. 2016-225057 discloses a technology of a rubber stopper assembly including a rubber stopper that has a shaft part for preventing water from entering the inside of the housing, a cover to be fixed to the housing, and a rubber stopper holder.

To prevent water from entering a passage part provided on a casing by mounting a cover for holding the packing on the casing, it is preferable to prevent axial displacement between the passage part and the packing. By suppressing axial deviation, the waterproof performance by the packing can be improved and the like.

SUMMARY OF THE INVENTION

An object of the present invention is to provide a packing mounting structure that can suppress axial deviation between a passage part and packing.

In order to achieve the above mentioned object, a packing mounting structure according to one aspect of the present invention includes a casing that houses a power detection terminal, and that includes a passage part on a wall part facing the power detection terminal, the passage part connecting an external space with an internal space; a packing that includes a seal part configured to close the passage part, and a portion to be held protruding toward an axis direction of the seal part from the seal part; a cover that includes a hole part, that is installed on the casing in a state in which the portion to be held is held by the hole part, and that closes the passage part by the packing; and a fastening member that fastens the casing and the cover to a device serving as an object to which the casing and the cover are to be mounted, wherein the portion to be held includes a shaft part, a first flange part disposed on a tip end part of the shaft part, and a second flange part disposed on a position closer to the seal part in the shaft part, and the hole part includes a narrow part having a narrower width than an outer diameter of the shaft part; an insertion hole part that is linked to one end of the narrow part, and that has a planar shape through which the first flange part is capable of passing; and a holding hole part that is linked to another end of the narrow part, that has a planar shape through which the first flange part is incapable of passing, and that is configured to hold the shaft part in a state in which a gap is formed between the holding hole part and the shaft part.

According to another aspect of the present invention, in the packing mounting structure, it is preferable that the fastening member is a screw member that fastens together the cover and the casing to the device, the hole part is formed on a wall part along a fastening direction by the fastening member in the cover, and an extending direction of the narrow part is inclined with respect to the fastening direction by the fastening member.

According to still another aspect of the present invention, in the packing mounting structure, it is preferable that the hole part is formed on a wall part along a direction of a fastening force in the cover, the fastening force being applied to the cover toward the device, and the planar shape of the holding hole part is an elongated hole a major-axis direction of which is the direction of the fastening force toward the device.

According to still another aspect of the present invention, in the packing mounting structure, it is preferable that the seal part is integrally molded with the portion to be held.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a packing mounting structure according to an embodiment of the present invention will be described in detail with reference to the accompanying drawings. However, the present invention is not limited to the embodiment. Moreover, components in the following embodiment include components that can be easily assumed by those skilled in the art or components that are substantially the same.

Embodiment

Figure 1:
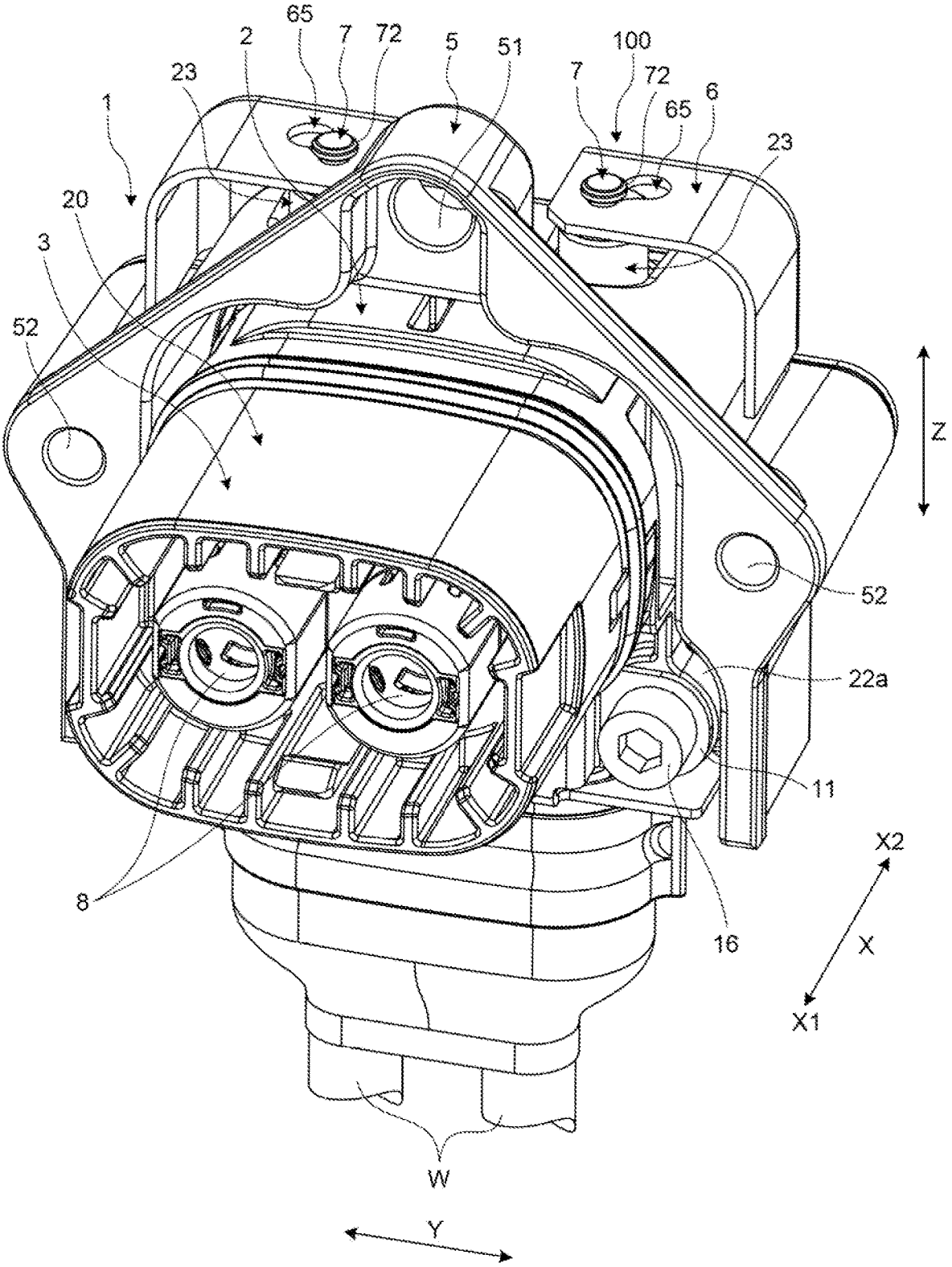
FIG. 1 is a perspective view of a packing mounting structure according to an embodiment.
Figure 2:
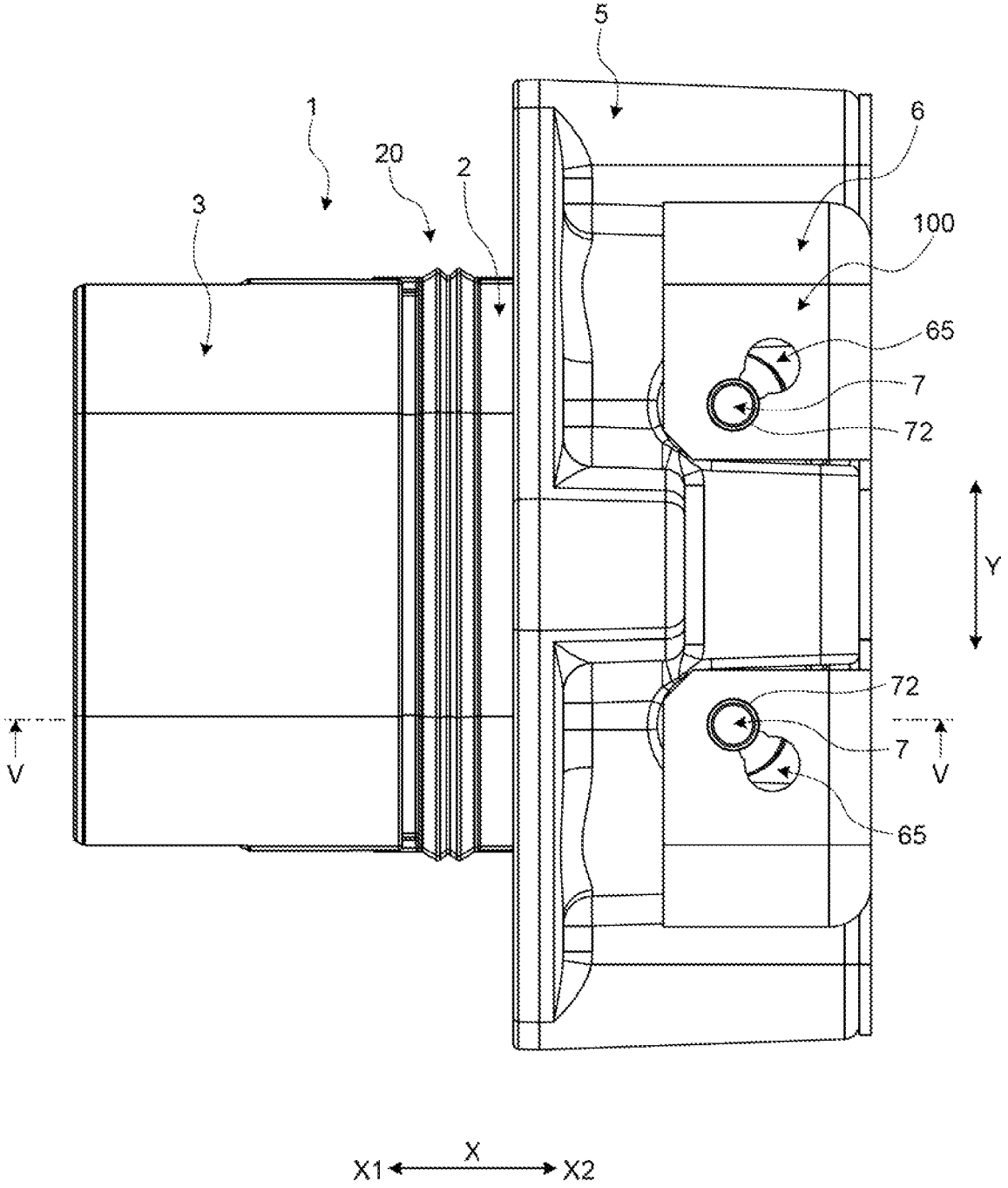
FIG. 2 is a plan view of the packing mounting structure according to the embodiment.
Figure 3:
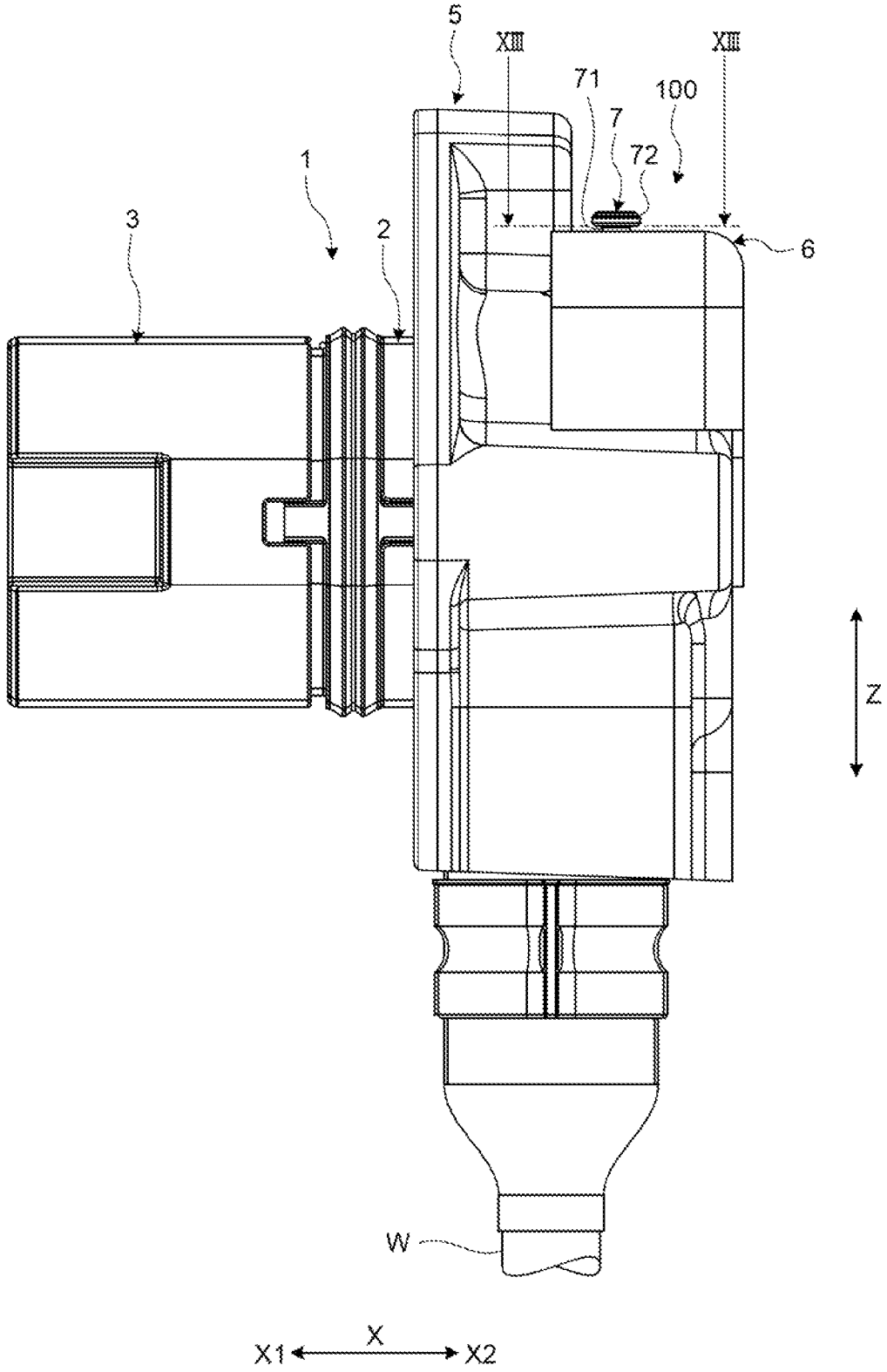
FIG. 3 is a side view of the packing mounting structure according to the embodiment.
Figure 4:
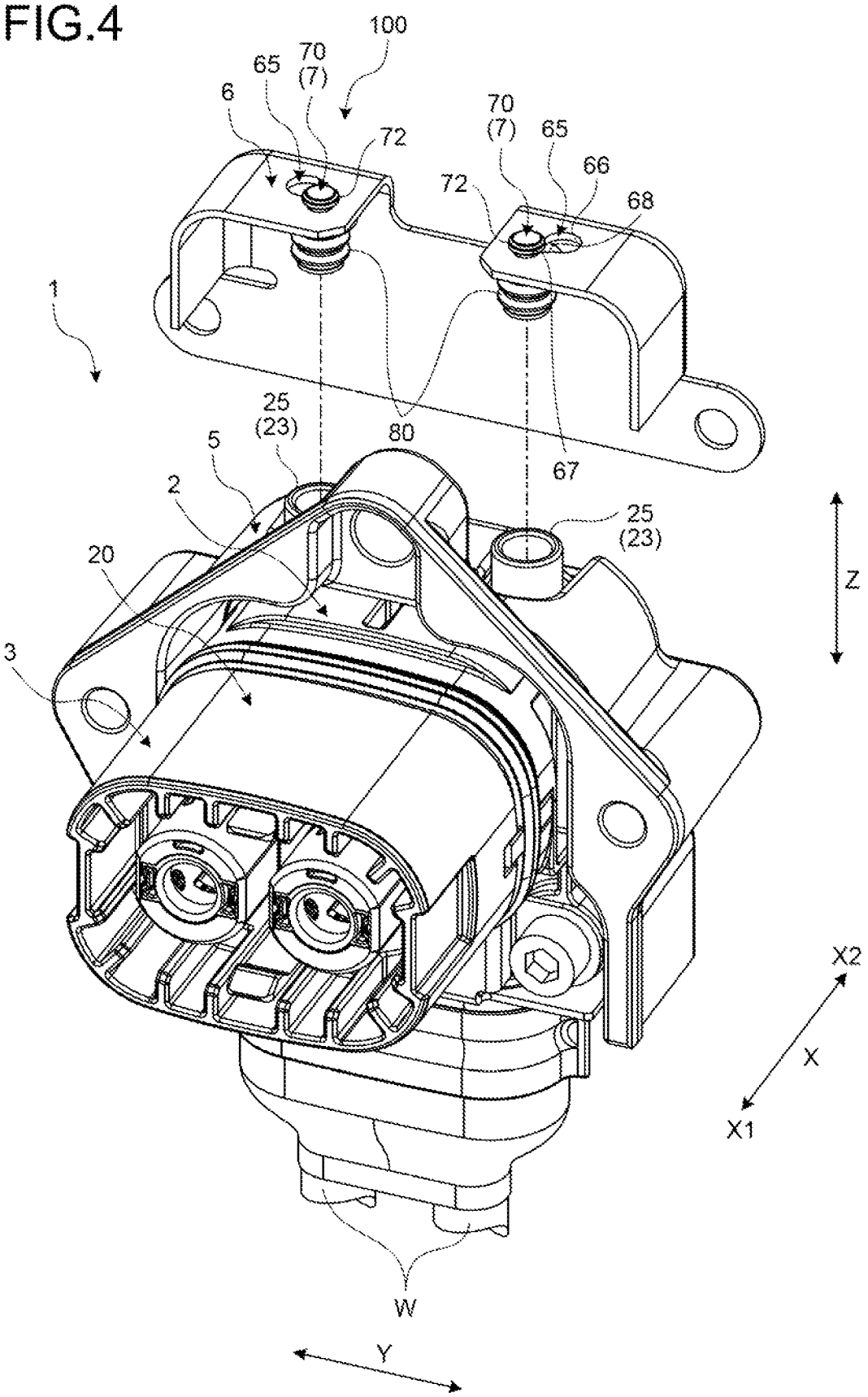
FIG. 4 is an exploded perspective view of the packing mounting structure according to the embodiment.
Figure 5:
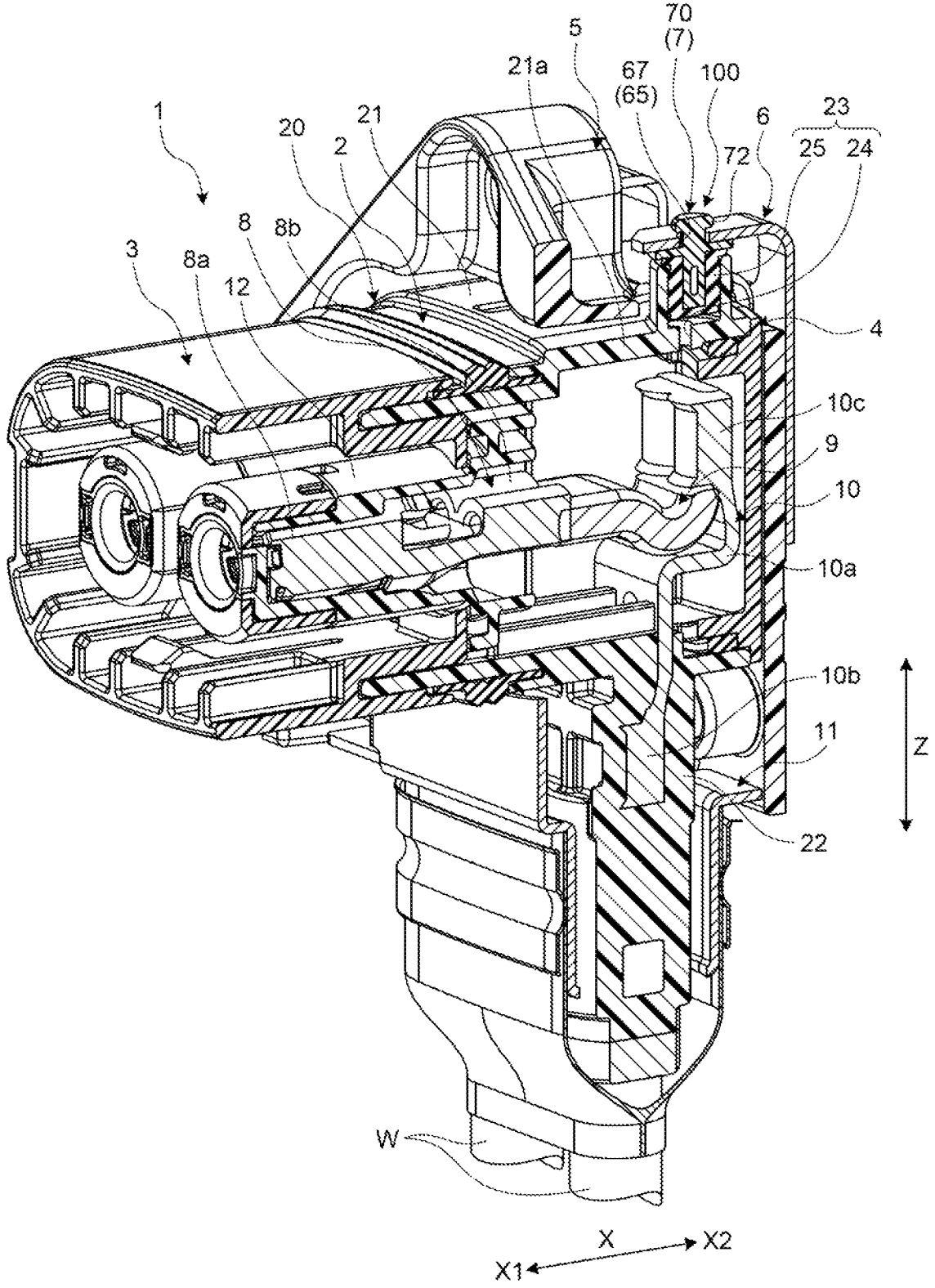
FIG. 5 is a sectional perspective view of the packing mounting structure according to the embodiment.
Figure 6:
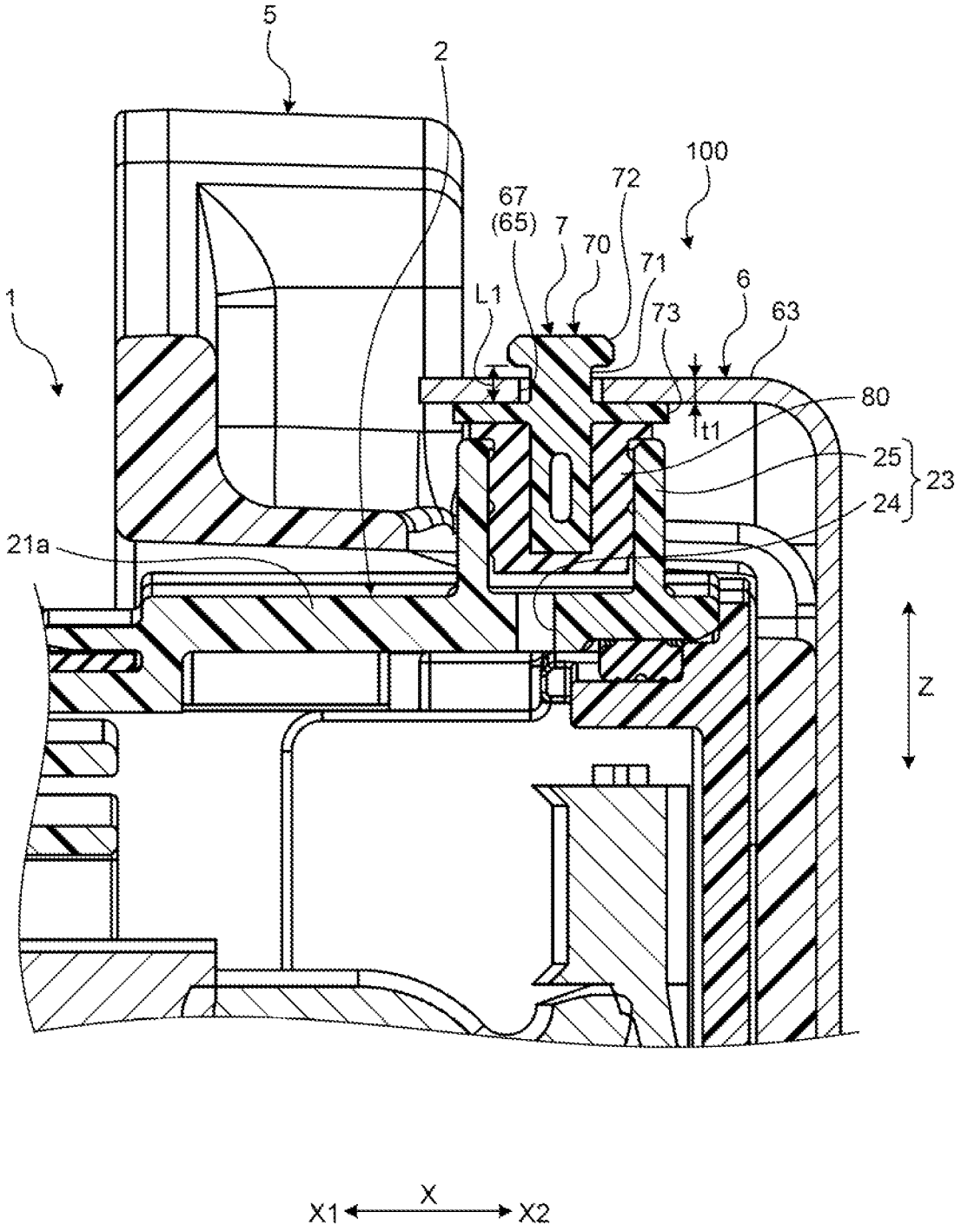
FIG. 6 is a sectional view of an essential part of the packing mounting structure according to the embodiment.
Figure 7:
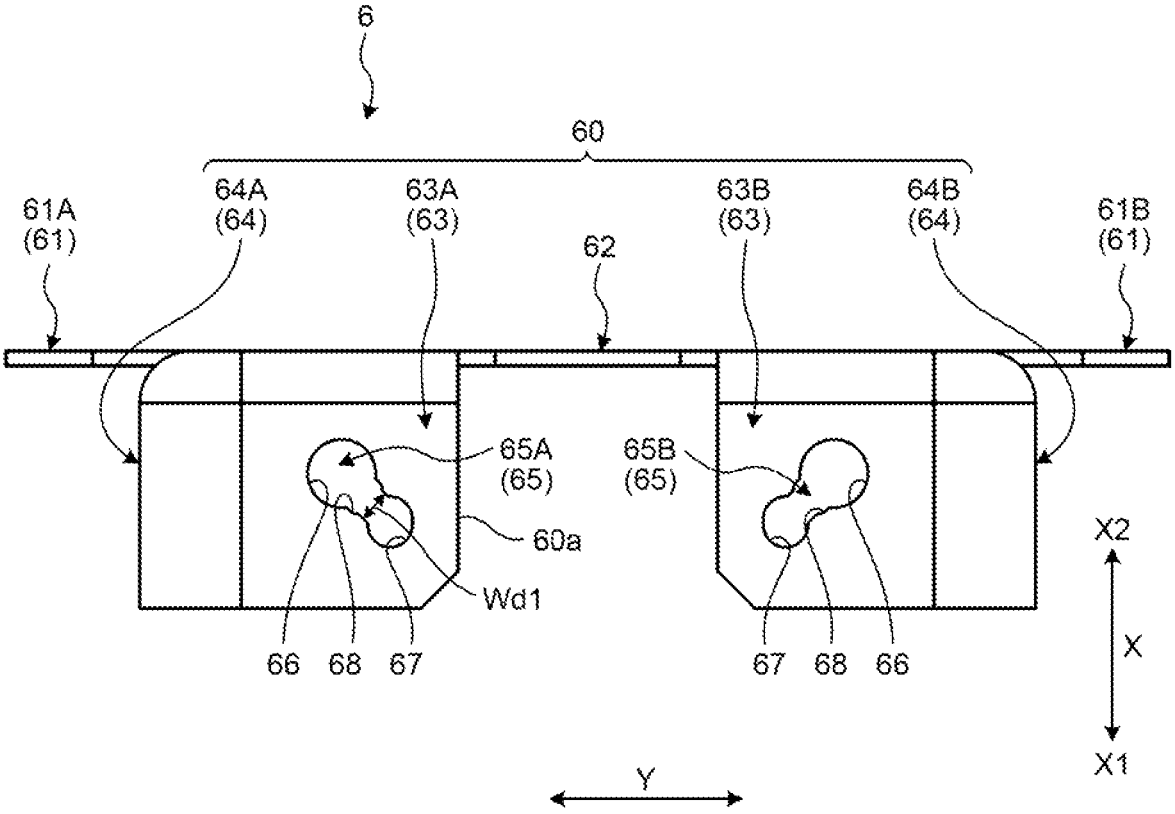
FIG. 7 is a plan view of a cover according to the embodiment.
Figure 8:
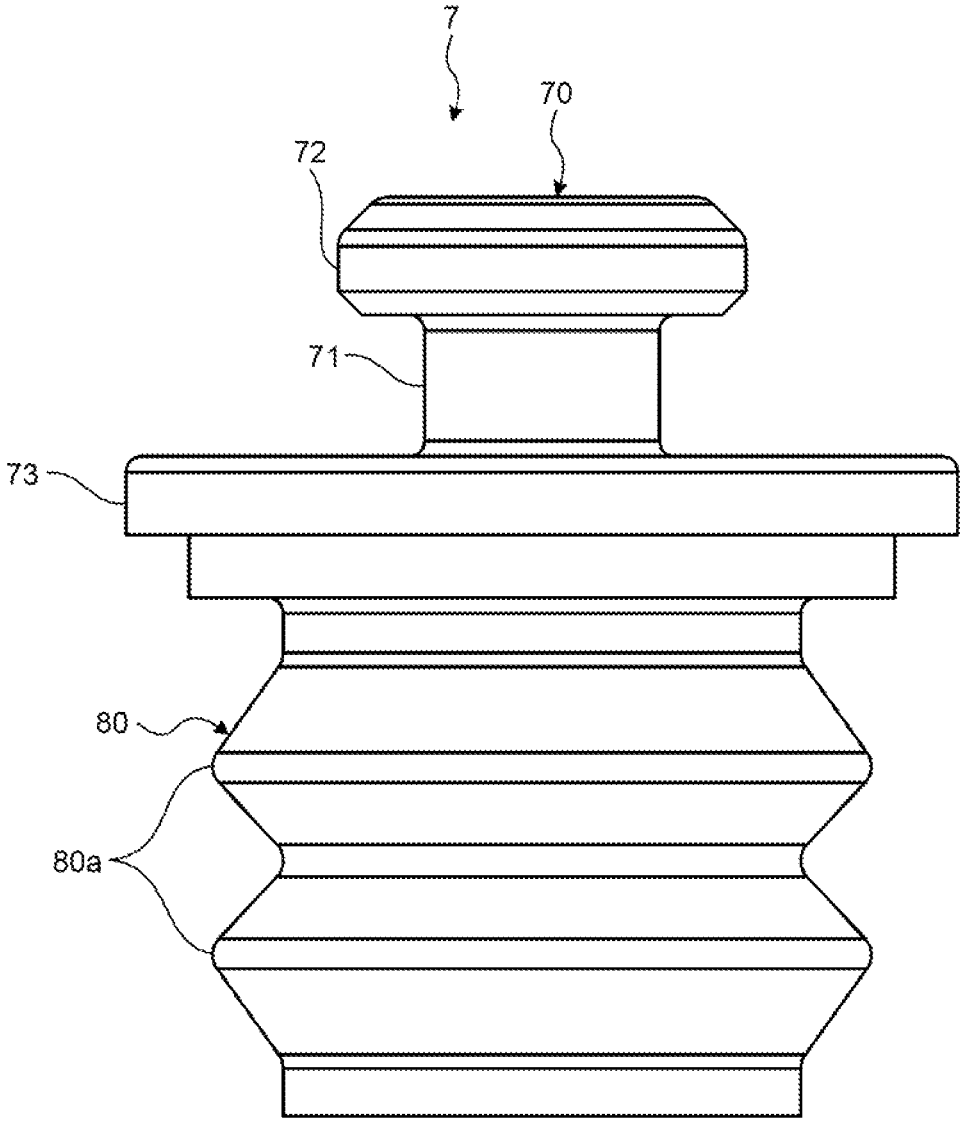
FIG. 8 is a front view of a packing according to the embodiment.
Figure 9:
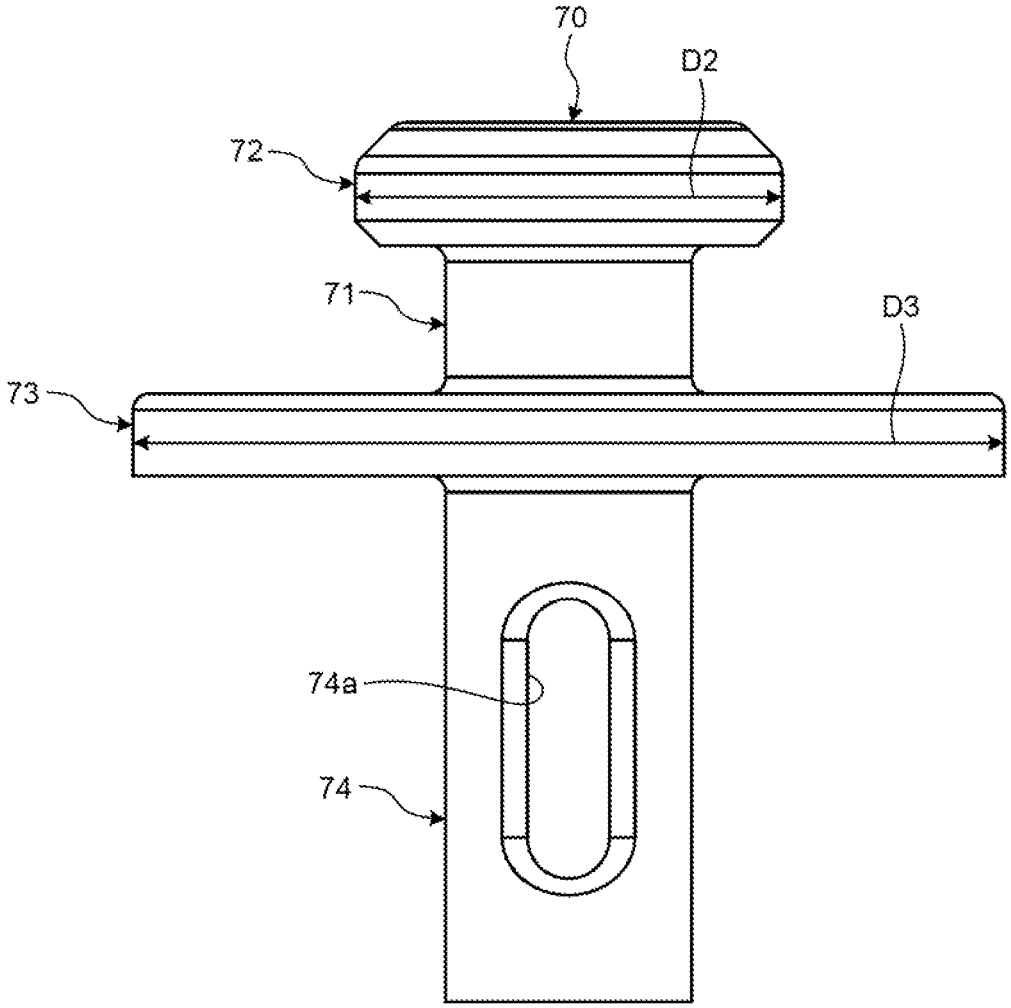
FIG. 9 is a front view of a main body of the packing according to the embodiment.
Figure 10:
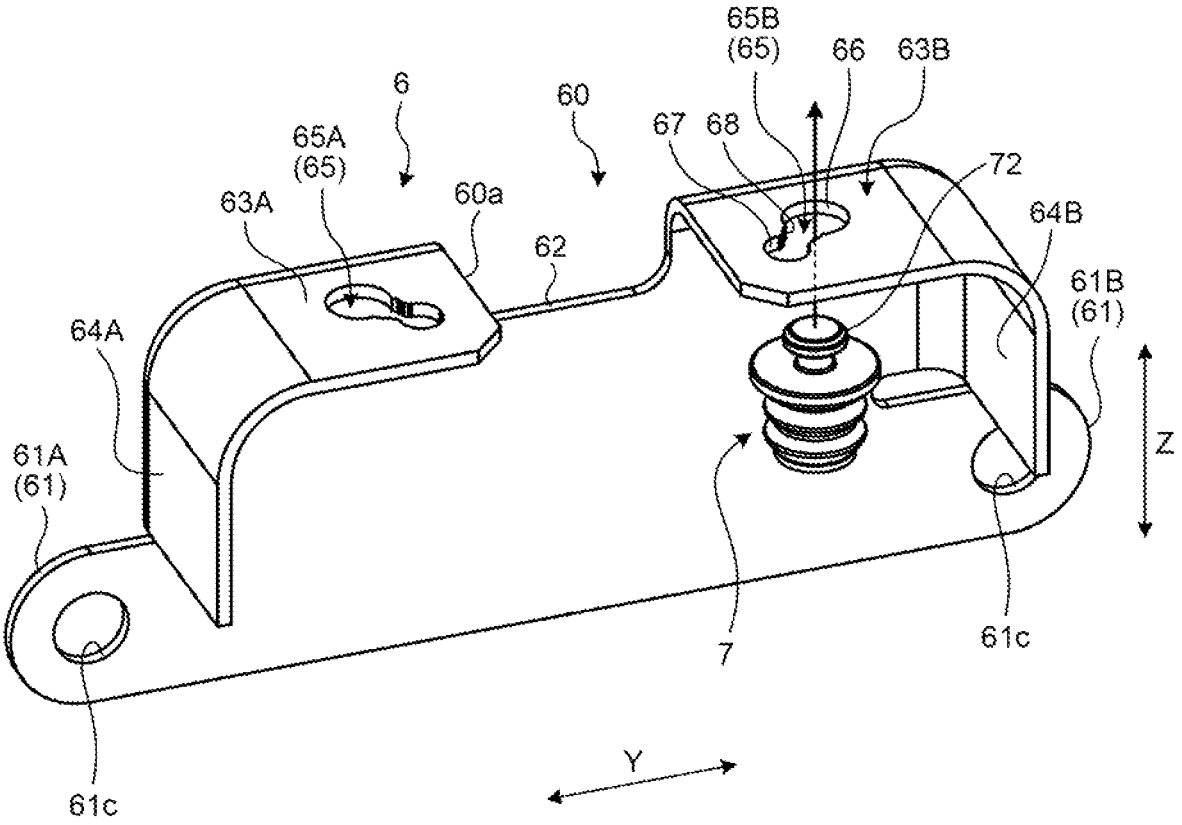
FIG. 10 is a perspective view for explaining how the packing is mounted on the cover.
Figure 11:
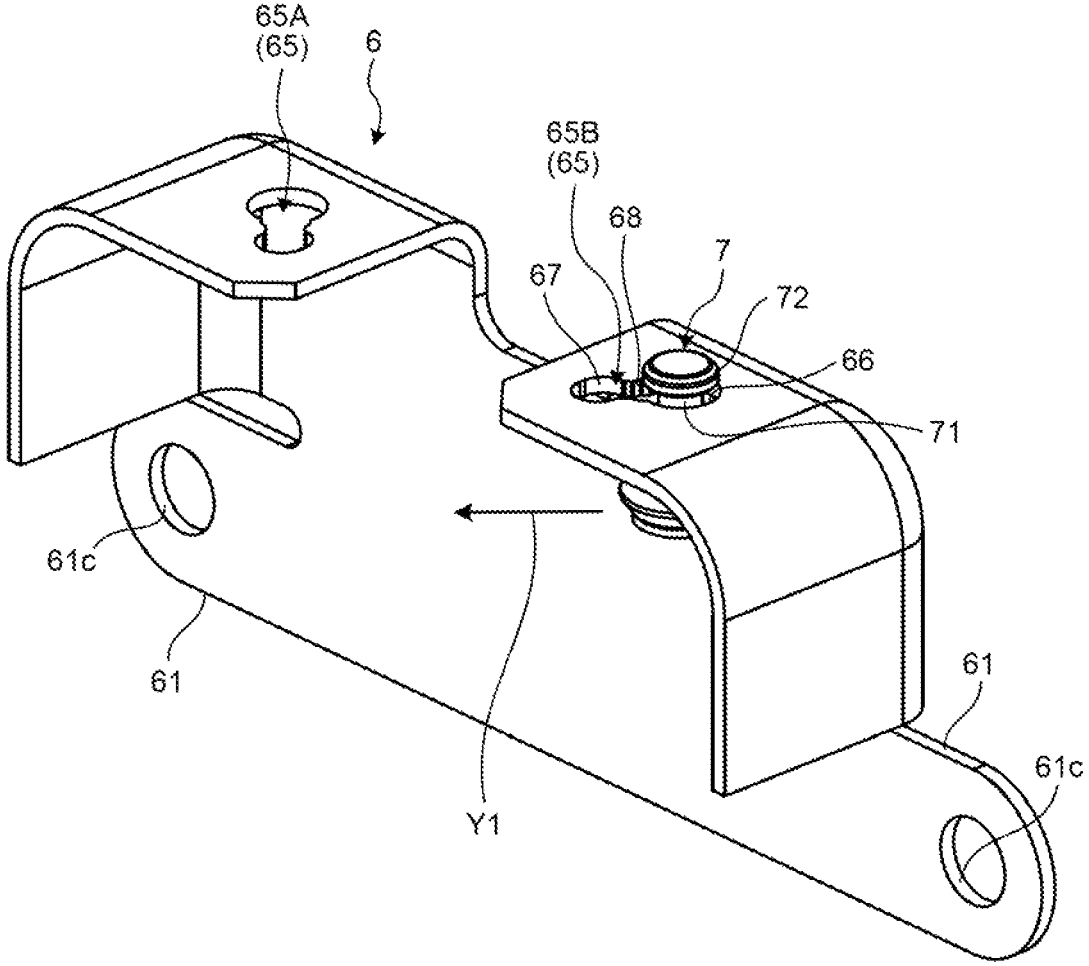
FIG. 11 is another perspective view for explaining how the packing is mounted on the cover.
Figure 12:
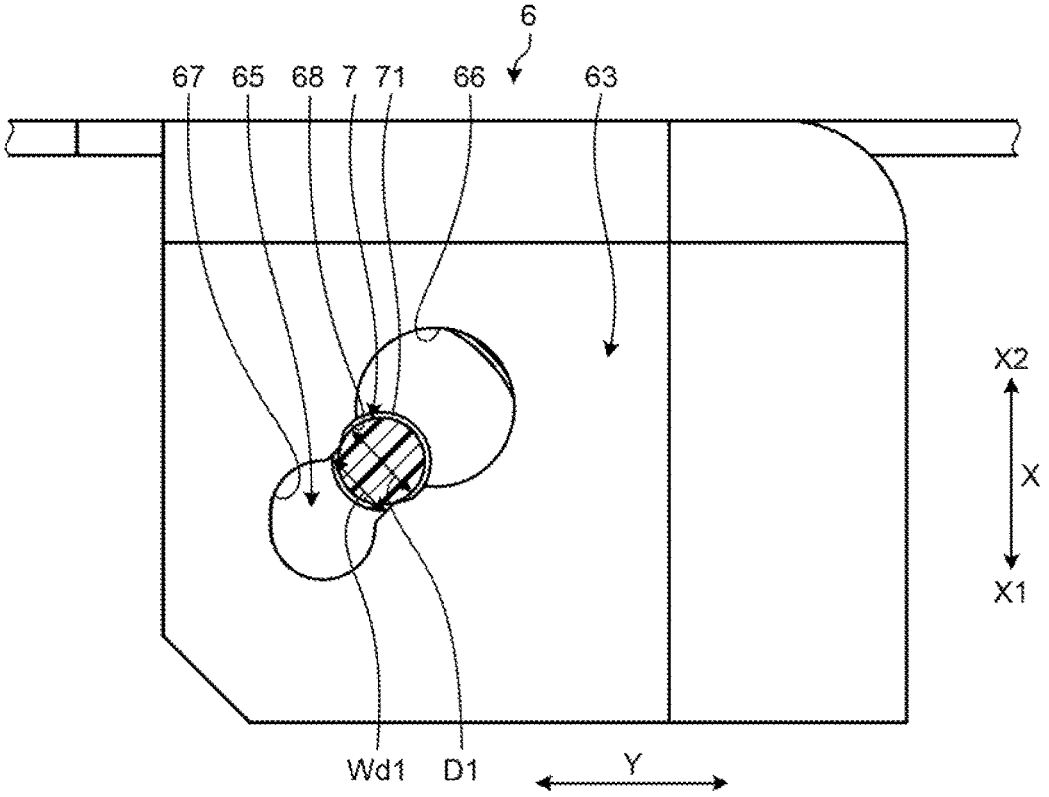
FIG. 12 is a sectional view for explaining the size of a hole part.
Figure 13:
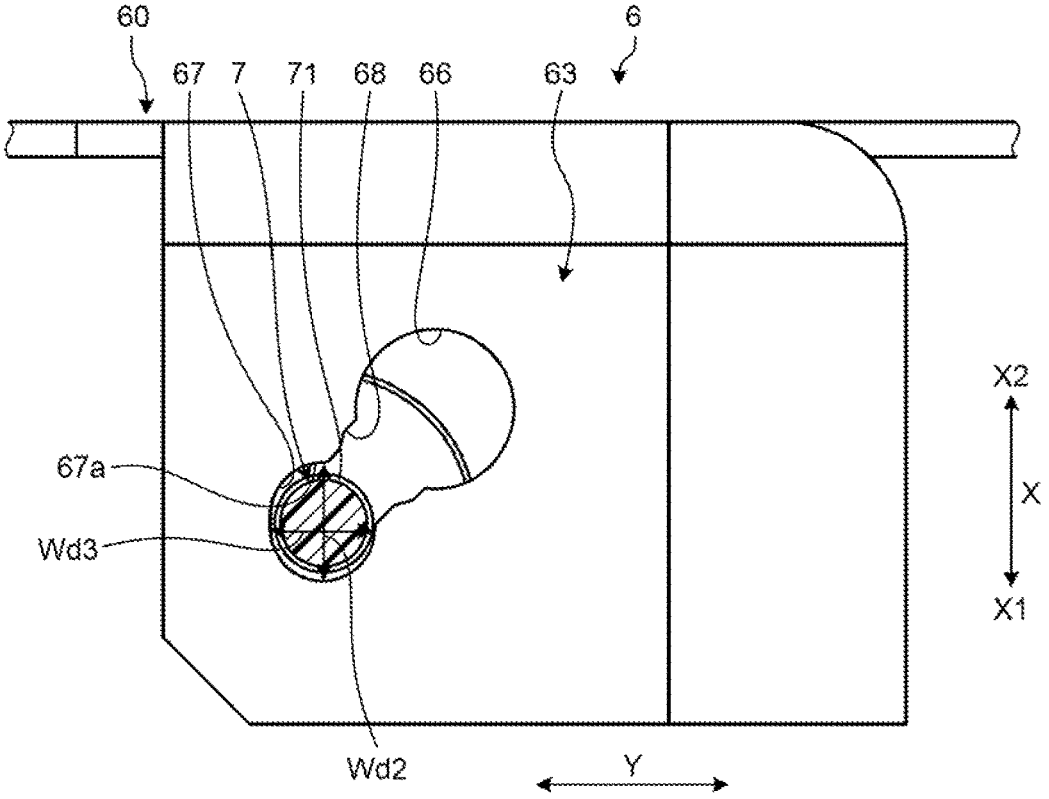
FIG. 13 is a sectional view illustrating a shaft part held by a holding hole part.
Figure 14:
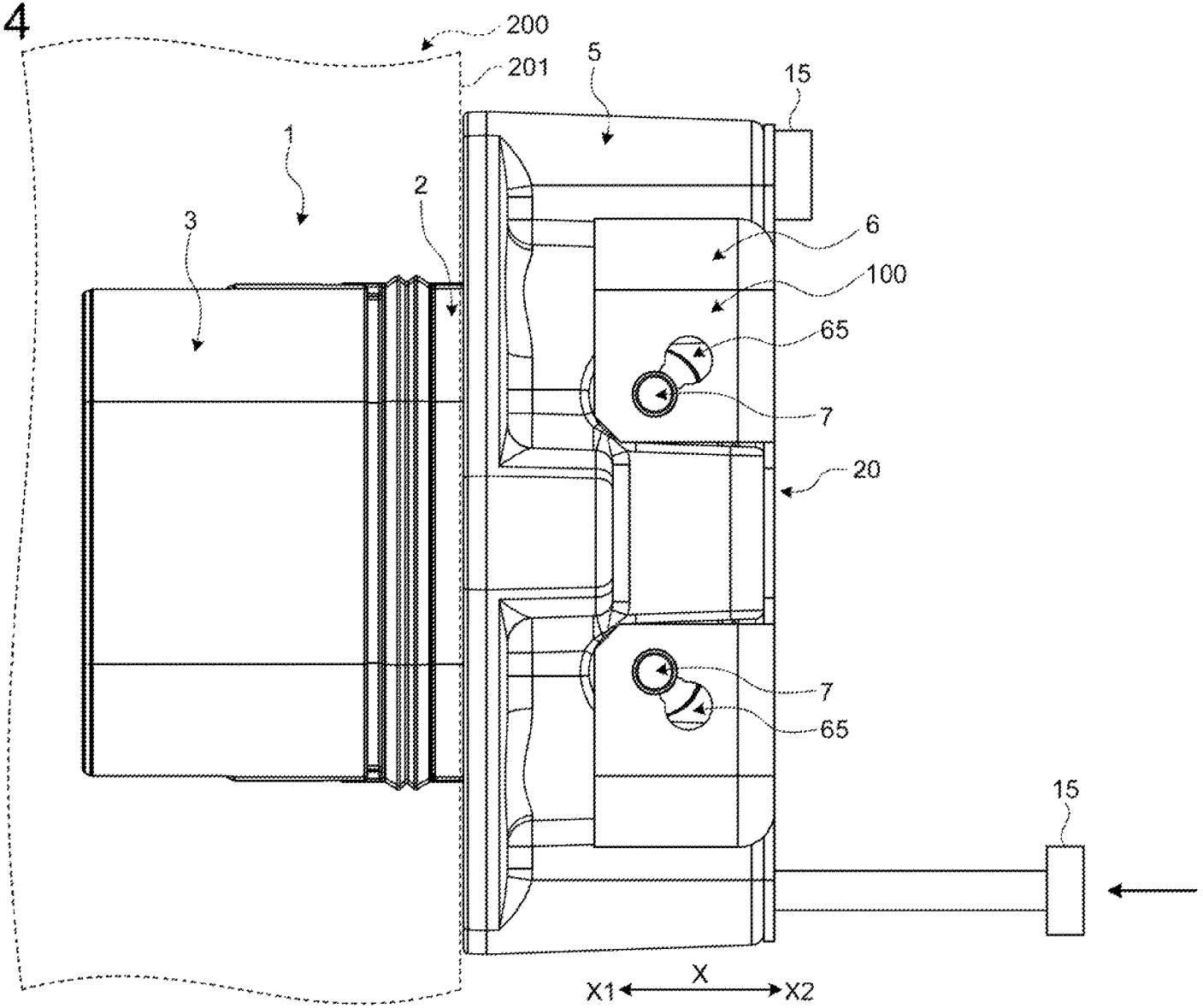
FIG. 14 is a plan view for explaining how a connector is fixed to a counterpart device.

With reference to FIG. 1 to FIG. 14, an embodiment will be described. The present embodiment relates to a packing mounting structure. FIG. 1 is a perspective view of the packing mounting structure according to the embodiment. FIG. 2 is a plan view of the packing mounting structure according to the embodiment. FIG. 3 is a side view of the packing mounting structure according to the embodiment. FIG. 4 is an exploded perspective view of the packing mounting structure according to the embodiment. FIG. 5 is a sectional perspective view of the packing mounting structure according to the embodiment. FIG. 6 is a sectional view of an essential part of the packing mounting structure according to the embodiment. FIG. 7 is a plan view of a cover according to the embodiment. FIG. 8 is a front view of packing according to the embodiment. FIG. 9 is a front view of a main body of the packing according to the embodiment. FIG. 10 is a perspective view for explaining how the packing is mounted on the cover. FIG. 11 is another perspective view for explaining how the packing is mounted on the cover. FIG. 12 is a sectional view for explaining the size of a hole part. FIG. 13 is a sectional view illustrating a shaft part held by a holding hole part. FIG. 14 is a plan view for explaining how a connector is fixed to a counterpart device.

FIG. 5 is a cross section cut along the line V-V of FIG. 2. FIG. 6 is an essential part of the sectional view of FIG. 5. FIG. 13 is a cross section cut along the line XIII-XIII of FIG. 3.

A packing mounting structure 100 of the present embodiment is a mounting structure for mounting packing 7 on a casing 20 of a connector 1. The connector 1 is a female connector including a pair of female terminals 8. The two terminals 8 are disposed in parallel. The connector 1 is connected to a counterpart device 200 (see FIG. 14). For example, the connector 1 connects between the counterpart device 200 and a power supply. The counterpart device 200 is a device to which the connector 1 is to be mounted, and for example, is an inverter.

As illustrated in FIG. 1 to FIG. 5, the connector 1 includes a main body 2, a front holder 3, a rear holder 4, a fixing member 5, a cover 6, the packing 7, a terminal 8, a flexible conductor 9, a bus bar 10, a shield shell 11, and a housing 12. The packing mounting structure 100 of the present embodiment includes the casing 20, the cover 6, and the packing 7. Moreover, the packing mounting structure 100 includes a fastening member 15 (see FIG. 14).

The casing 20 of the connector 1 is configured by the main body 2, the front holder 3, the rear holder 4, and the fixing member 5. For example, the main body 2, the front holder 3, and the rear holder 4 are made of insulating synthetic resin. The terminal 8, the flexible conductor 9, which will be described below, the bus bar 10, and the like are housed inside the casing 20. The main body 2 is the main portion of the casing 20. As illustrated in FIG. 5, the main body 2 has a tubular-shaped tubular part 21, and a protrusion part 22. The cross sectional shape of the tubular part 21 of the present embodiment is a substantially elliptical shape. The protrusion part 22 protrudes from the tubular part 21 in a direction perpendicular to the axis direction of the tubular part 21. The protrusion part 22 is formed in a hollow shape, and the internal space of the tubular part 21 and the internal space of the protrusion part 22 communicate with each other.

In the following explanation, the axis direction of the tubular part 21 is simply referred to as an "axis direction X". The side toward the counterpart device 200 in the axis direction X is referred to as a "front surface side X1", and the side opposite to the front surface side X1 is referred to as a "rear surface side X2". Moreover, a direction of arranging the pair of the terminals 8 is referred to as a "width direction Y". The width direction Y is perpendicular to the axis direction X. A direction perpendicular to the axis direction X and the width direction Y is referred to as a "height direction Z". The protrusion part 22 protrudes in the height direction Z.

Two wires W are inserted into the protrusion part 22. Each of the wires W is a coated wire the core wire of which is coated by an insulating coating. One of the wires W is connected to one of the pair of terminals 8, and the other wire W is connected to the other of the pair of terminals 8. The bus bar 10 is a plate-shaped conductive member made of conductive metal. The connector 1 of the present embodiment includes one bus bar 10 for one terminal 8. Thus, the connector 1 includes two bus bars 10. The bus bar 10 includes a main body 10*a*, a first connection part 10*b*, and a second connection part 10*c*. The main body 10*a* is a plate-shaped component, and bends at two locations along the longitudinal direction. The first connection part 10*b* is disposed on one of the ends or the main body 10*a*, and the second connection part 10*c* is disposed on the other end of the main body 10*a*. The first connection part 10*b* is located inside the protrusion part 22, and is caulked to the core wire of the wire W. The second connection part 10*c* is located inside the tubular part 21, and is caulked to the flexible conductor 9. That is, the bus bar 10 electrically connects the core wire of the wire W and the flexible conductor 9.

The flexible conductor 9 is a conductive member that electrically connects the bus bar 10 and the terminal 8. The flexible conductor 9 is a conductive member having flexibility higher than that of the bus bar 10, and extends in the axis direction X. One of the ends of the flexible conductor 9 is held by the second connection part 10*c* of the bus bar 10. The terminal 8 includes a connection part 8*a* and a caulking part 8*b*. The connection part 8*a* is formed in a cylindrical shape, and is connected to a counterpart terminal. The caulking part 8*b* is caulked to the other end of the flexible conductor 9.

The two terminals 8 are held by the housing 12. The housing 12 is made of insulating synthetic resin and the like. The housing 12 is held by the tubular part 21 inside the tubular part 21. The front holder 3 is mounted on the tubular part 21 from the front surface side X1. The housing 12 is interposed between the front holder 3 and the tubular part 21. The front holder 3 is a portion to be fitted to the counterpart device 200.

The rear holder 4 is mounted on the tubular part 21 from the rear surface side X2. The rear holder 4 closes the opening of the tubular part 21 on the rear surface side X2. The shield shell 11 is a conductive member that covers the protrusion part 22. For example, the shield shell 11 is grounded to the casing of the counterpart device 200.

The fixing member 5 is a member to be fixed to the counterpart device 200. For example, the fixing member 5 is made of conductive metal such as aluminum. By being grounded to the casing of the counterpart device 200, the fixing member 5 can function as a shield shell. The fixing member 5 covers the main body 2 from the rear surface side X2 and the sides. Is illustrated in FIG. 1, the fixing member 5 includes a first insertion hole 51 and two second insertion holes 52. The first insertion hole 51 and the second insertion holes 52 penetrate through the fixing member 5 in the axis direction X. The second insertion holes 52 are disposed one by one on both ends of the fixing member 5 in the width direction Y.

As illustrated in FIG. 1, the shield shell 11 is fixed to the fixing member 5 by a screw 16. More specifically, the screw 16 is inserted into the shield shell 11 and a fixing part 22*a* of the main body 2, and is screwed to the fixing member 5. That is, the main body 2 and the fixing member 5 are coupled to each other via the screw 16.

As illustrated in FIG. 5 and the like, the main body 2 of the casing 20 includes a passage part 23. The passage part 23 connects the internal space of the casing 20 with the external space. The passage part 23 is formed on a position facing the second connection part 10*c* of the bus bar 10. More specifically, the passage part 23 of the present embodiment is formed on a top wall part 21*a* of the main body 2. The top wall part 21*a* is a part of the tubular part 21, and faces the bus bar 10 in the height direction Z. In the top wall part 21*a*, the passage part 23 is disposed on the extension of the second connection part 10*c*. A power detection probe is inserted into the passage part 23. The passage part 23 guides the probe to the second connection part 10*c*. In a state in which the probe is brought into contact with the second connection part 10*c*, the presence or absence of energizing is checked. That is, the second connection part 10*c* functions as a power detection terminal that detects whether energizing is performed through the terminal 8.

The passage part 23 of the present embodiment includes a through hole 24 and a cylinder part 25. The through hole 24 penetrates through the top wall part 21*a* of the tubular part 21. The through hole 24 is disposed on a position facing the second connection part 10*c*. The cross sectional shape of the through hole 24 in the present embodiment is circular. The cylinder part 25 protrudes from the outer side surface of the top wall part 21*a*, and surrounds the through hole 24. The cylinder part 25 of the present embodiment is formed in a cylindrical shape. The cylinder part 25 is coaxially disposed with the through hole 24. The cylinder part 25 protrudes in the direction opposite to the protruding direction of the protrusion part 22 along the height direction Z. Two passage parts 23 are disposed in parallel in the width direction Y on the main body 2 or the present embodiment. One of the passage parts 23 faces one of the two bus bars 10, and the other passage part 23 faces the other of the two bus bars 10.

The cover 6 is a member for holding the packing 7, and is fixed to the casing 20. For example, the cover 6 is made of conductive metal. The cover 6 of the present embodiment covers the fixing member 5 from the rear surface side X2 and both sides in the width direction Y. The cover 6 is installed on the casing 20 in a state or holding the packing 7. In this process, the packing 7 is inserted into the cylinder part 25 of the passage part 23, and closes the cylinder part 25.

The packing mounting structure 100 of the present embodiment will now be described in detail. As illustrated in FIG. 7 and FIG. 10, the cover 6 includes a main body 60 and a fixing plate part 61. The main body 60 includes a main wall part 62, a top wall part 63, and a side wall part 64. The main wall part 62 is a wall part facing the fixing member 5 in the axis direction X. The main wall part 62 covers the fixing member 5 from the rear surface side X2. The top wall part 63 is a wall part facing the fixing member 5 in the height direction Z. The top wall part 63 faces the passage part 23 of the casing 20. The side wall part 64 is a wall part facing the fixing member 5 in the width direction Y. As the side wall part 64, the cover 6 includes a first side wall part 64A and a second side wall part 64B. By a pair of the side wall parts 64A and 64B, the cover 6 covers the fixing member 5 from both sides in the width direction Y. On the top wall part 63 and the main wall part 62, a notch 60*a* from which a part of the fixing member 5 is exposed is provided. The top wall part 63 is divided into a first top wall part 63A and a second top wall part 63B by the notch 60*a*. The first top wall part 63A faces one of the passage parts 23, and the second top wall part 63B faces the other passage part 23.

The fixing plate part 61 protrudes from the main body 60 in the width direction Y. The fixing plate part 61 of the present embodiment includes a first plate part 61A and a second plate part 61B. The first plate part 61A protrudes in the width direction Y from one of the ends of the main wall part 62 in the width direction Y. The second plate part 61B protrudes in the width direction Y from the other end of the main wall part 62 in the width direction Y. That is, the first plate part 61A and the second plate part 61B protrude from the main wall part 62 in opposite directions. The first plate part 61A and the second plate part 61B each include a through hole 61*c*.

The cover 6 includes a hole part 65 for holding the packing 7. The hole part 65 is disposed on each of the first top wall part 63A and the second top wall part 63B. In the following explanation, when distinguishing the two hole parts 65, the hole part 65 provided on the first top wall part 63A is referred to as a hole part 65A, and the hole part 65 provided on the second top wall part 63B is referred to as a hole part 65B. When there is no need to particularly distinguish the two hole parts 65, the hole parts 65 may be simply and collectively referred to as a hole part 65.

The hole part 65 includes an insertion hole part 66, a holding hole part 67, and a narrow part 68. The planar shape of the insertion hole part 66 and the holding hole part 67 is circular. The narrow part 68 links the insertion hole part 66 with the holding hole part 67. The width Wd1 of the narrow part 68 is narrower than either of the width of the insertion bole part 66 and the width of the holding hole part 67. As will be described below, the width Wd1 of the narrow part 68 is smaller than the outer diameter of a shaft part 71 of the packing 7.

As illustrated in FIG. 8, the packing 7 includes a main body 70 and a seal part 80. In the packing 7 of the present embodiment, the seal part 80 is integrally molded with the main body 70. For example, the main body 70 and the seal part 80 are made of synthetic resin. The seal part 80 is formed of a material excellent in flexibility and elasticity such as rubber. Compared to the seal part 80, the main body 70 is formed of a material having a high rigidity. The cross sectional shape of the seal part 80 is a circular cylinder shape or a rod shape. The seal part 80 includes a plurality of lips 80*a*. Each of the lips 80*a* is a portion protruding relative to the adjacent portions, and can enhance the adhesion property of the seal part 80 to the cylinder part 25.

As illustrated in FIG. 9, the main body 70 includes the shaft part 71, a first flange part 72, a second flange part 73, and a column part 74. The shaft part 71 is a rod-shaped component the cross sectional shape of which is circular. The first flange part 72 and the second flange part 73 protrude in a direction perpendicular to the center axis line of the shaft part 71. For example, the first flange part 72 and the second flange part 73 are formed in a disk-shape. The diameter D3 of the second flange part 73 is larger than the diameter D2 of the first flange part 72. The first flange part 72 is disposed on a tip end part of the shaft part 71. The second flange part 73 is disposed on a position closer to the seal part 80 in the shaft part 71. That is, the second flange part 73 is disposed between the first flange part 72 and the seal part 80.

The first flange part 72 and the second flange part 73 are disposed with a predetermined interval therebetween. The column part 74 protrudes toward the side opposite to the first flange part 72 side from the second flange part 73. The column part 74 of the present embodiment is formed in a columnar-shape. The column part 74 includes a through hole 74*a*. The through hole 74*a* penetrates through the column part 74 in a direction perpendicular to the center axis line of the column part 74. The seal part 80 is integrally molded with the column part 74. The holding force of the seal part 80 to hold the column part 74 is improved by the through hole 74*a*.

With reference to FIG. 10 and FIG. 11, a method of mounting the packing 7 on the cover 6 will be described. As illustrated in FIG. 10, the packing 7 is inserted into the insertion hole part 66 of the hole part 65 with the first flange part 72 as the tip end. The planar shape of the insertion hole part 66 is formed such that the first flange part 72 can pass through. More specifically, the planar shape of the insertion hole part 66 of the present embodiment is circular, and the diameter of the insertion hole part 66 is larger than the diameter D2 of the first flange part 72. Moreover, the diameter of the insertion hole part 66 is smaller than the diameter D3 of the second flange part 73. Thus, the insertion hole part 66 allows the first flange part 72 to pass through, but restricts the second flange part 73 from passing through.

When the first flange part 72 passes through the insertion hole part 66, as illustrated in an arrow Y1 in FIG. 11, the packing 7 is slid toward the holding hole part 67. Consequently, the shaft part 71 passes through the narrow part 68 toward the holding hole part 67. As illustrated in FIG. 12, in the cover 6 of the present embodiment, the width Wd1 of the narrow part 68 is smaller than the diameter D1 of the shaft part 71. The width Wd1 of the narrow part 68 is set so that the shaft part 71 can pass through the narrow part 68 by being elastically deformed. Thus, when a worker presses the packing 7 toward the holding hole part 67, the shaft part 71 passes through the narrow part 68 while being elastically deformed. The width Wd1 of the narrow part 68 of the present embodiment is gradually narrowed from the insertion hole part 66 toward the holding hole part 67. The width Wd1 of the narrow part 68 is set smaller than the diameter D1 at least at a portion with the narrowest width.

As will be described with reference to FIG. 13, the planar shape of the holding hole part 67 is formed such that the first flange part 72 cannot pass through but that the shaft part 71 can be received. The planar shape of the holding hole part 67 of the present embodiment is formed in an elongated hole shape. The major-axis direction of the holding hole part 67 is the axis direction X. The width Wd2 of the holding hole part 67 in the axis direction X is larger than the diameter D1 of the shaft part 71, and is smaller than the diameter D2 of the first flange part 72. Moreover, the width Wd3 of the holding hole part 67 in the width direction Y is larger than the diameter D1 of the shaft part 71, and is smaller than the width Wd2. Thus, the holding hole part 67 can hold the shaft part 71 in a state in which a gap is formed between the holding hole part 67 and the shaft part 71. In other words, the holding hole part 67 holds the shaft part 71 while allowing the shaft part 71 to move relative to the cover 6 in the axis direction X and the width direction Y.

Because the width Wd2 of the holding hole part 67 in the axis direction X is smaller than the diameter D2 of the first flange part 72, the first flange part 72 cannot pass through the holding hole part 67. That is, in a state in which the shaft part 71 is held by the holding hole part 67, the first flange part 72 is restricted from coining out from the hole part 65.

Moreover, in the hole part 65 of the present embodiment, the major-axis direction of the holding hole part 67 is the axis direction X. Therefore, the holding hole part 67 allows the shaft part 71 to move relative to the cover 6 in the axis direction X. Therefore, as will be described below, the packing mounting structure 100 of the present embodiment can allow the packing 7 to appropriately follow the passage part 23.

When two pieces of the packing 7 are assembled to the two hole parts 65 of the cover 6, the cover 6 is installed on the casing 20. As illustrated in FIG. 4, the cover 6 is installed on the casing 20 while being moved in the height direction Z. The two pieces of packing 7 held by the cover 6 are inserted into the two cylinder parts 25, respectively. In this process, the two pieces of packing 7 are allowed to move relative to the cover 6 while being held by the holding hole part 67. Therefore, the axes of the two pieces of packing 7 are automatically aligned with respect to the two cylinder parts 25.

When the cover 6 is installed on the casing 20, the connector 1 is fixed to the counterpart device 200. As illustrated in FIG. 14, the connector 1 is mounted on the counterpart device 200 so that the front holder 3 is fitted to the counterpart device 200. The front surface of the fixing member 5 comes into contact with a wall surface 201 of the counterpart device 200. The cover 6 may also be installed on the casing 20 after the casing 20 is fitted to the counterpart device 200. When the front holder 3 is fitted to the counterpart device 200, a male terminal of the counterpart device 200 is inserted into the terminal 8 of the connector 1.

The connector 1 is fixed to the counterpart device 200 by the fastening member 15. The fastening member 15 of the present embodiment is a screw member such as a bolt. The fastening member 15 is inserted into the through hole 61*c* (see FIG. 10) of the cover 6 and the second insertion hole 52 (see FIG. 1) of the fixing member 5, from the rear surface side X2 along the axis direction X. The fastening member 15 is screwed into a screw hole of the counterpart device 200, and fastens together the fixing member 5 and the cover 6. Moreover, a fastening member is inserted into the first insertion hole 51 of the fixing member 5, and is screwed to the counterpart device 200.

As described above, the holding hole part 67 of the present embodiment is configured to allow the packing 7 to move in the axis direction X. As describe with reference to FIG. 13, the width Wd2 of the holding hole part 67 in the axis direction X is larger than the diameter D1 of the shaft part 71. Hence, the packing 7 can move relative to the cover 6 along the axis direction X. Therefore, when the fastening member 15 is screwed to the counterpart device 200, the packing 7 can move relative to the cover 6 in the axis direction X and can absorb tolerance. As a result, with the packing mounting structure 100 according to the present embodiment, it is possible to suppress axial deviation of the packing 7 with respect to the passage part 23, and improve the waterproof performance.

Moreover, in the hole part 65 of the present embodiment, the extending direction of the narrow part 68 is inclined with respect to the axis direction X. In other words, the extending direction of the narrow part 68 is inclined with respect to the fastening direction by the fastening member 15. Therefore, when the fastening member 15 is used for fastening work, the shaft part 71 is restricted from moving toward the insertion hole part 66. As illustrated in FIG. 13, the holding hole part 67 of the present embodiment includes a facing wall part 67*a* that faces the shaft part 71 in the axis direction X. The facing wall part 67*a* is a wall part facing the front surface side X1, and engages with the shaft part 71 when the shaft part 71 is going to move toward the rear surface side X2. Therefore, when an external force toward the rear surface side X2 is applied to the packing 7, the holding hole part 67 is engaged with the shaft part 71, and restricts the shaft part 71 from moving toward the insertion hole part 66.

Furthermore, because the extending direction of the narrow part 68 is inclined with respect to the axis direction X, the size of the main body 60 of the cover 6 is prevented from increasing. Because the narrow part 68 is inclined with respect to the axis direction X, the hole part 65 can be disposed while minimizing the size of the top wall part 63 in the axis direction X and the width direction Y. For example, the extending direction of the narrow part 68 may also be a direction inclined by 45 degrees with respect to the axis direction X.

In the present embodiment, the planar shape of the holding hole part 67 is an elongated hole the major-axis direction of which is the axis direction X. That is, the fastening direction by the fastening member 15 is matched with the major-axis direction of the holding hole part 67. Therefore, the holding hole part 67 can maximize the movable amount of the packing 7 in the fastening direction.

As described above, the packing mounting structure 100 according to the present embodiment includes the casing 20, the packing 7, the cover 6, and the fastening member 15. The casing 20 houses the bus bar 10, and includes the passage part 23 that connects the external space of the casing 20 with the internal space, on the top wall part 21*a* facing the bus bar 10. The bus bar 10 is an example of a power detection terminal housed in the casing 20.

The packing 7 includes the seal part 80 that closes the passage part 23, and the main foody 70 that protrudes toward the axis direction of the seal part 80 from the seal part 80. The main body 70 is an example of a portion to be held provided on the packing 7. The cover 6 includes the hole part 65. The cover 6 is installed on the casing 20 in a state in which the main body 70 of the packing 7 is held by the hole part 65, and closes the passage part 23 by the packing 7. The fastening member 15 fastens the casing 20 and the cover 6 to the counterpart device 200.

The main body 70 serving as a portion to be held includes the shaft part 71, the first flange part 72, and the second flange part 73. The first flange part 72 is disposed on the tip end part of the shaft part 71. The second flange part 73 is disposed on a position closer to the seal part 80 in the shaft part 71.

The hole part 65 includes the narrow part 68, the insertion hole part 66, and the holding hole part 67. The width Wd1 of the narrow part 68 is narrower than the outer diameter of the shaft part 71. The insertion hole part 66 is a portion linked to one of the ends of the narrow part 68, and has a planar shape through which the first flange part 72 is capable of passing. The holding hole part 67 is a portion linked to the other end of the narrow part 68, has a planar shape through which the first flange part 72 is incapable of passing, and that holds the shaft part 71 in a state in which a gap is formed between the holding hole part 67 and the shaft part 71.

In the packing mounting structure 100 according to the present embodiment, the cover 6 is installed on the casing 20 so that the passage part 23 is closed by the packing 7, in a state in which the packing 7 is held by the holding hole part 67. Because a gap is provided between the shaft part 71 of the packing 7 and the holding hole part 67, the packing 7 can move relative to the cover 6 by following the passage part 23. Therefore, the packing mounting structure 100 according to the present embodiment can suppress axial deviation of the packing 7 with respect to the passage part 23. Moreover, in the packing mounting structure 100 according to the present embodiment, a member for preventing the rotation of the packing 7 is not required. Hence, the size of the packing is reduced, and the material cost is reduced. Furthermore, because an assembling direction (rotation position) of the packing 7 to the cover 6 is not limited, the assembling workability will be improved.

The fastening member 15 of the present embodiment is a screw member that fastens together the cover 6 and the casing 20 to the counterpart device 200. The hole part 65 is formed on the top wall part 63 of the cover 6. The top wall part 63 is an example of a wall part along the fastening direction by the fastening member 15. The extending direction of the narrow part 68 is inclined with respect to the fastening direction by the fastening member 15. Therefore, with the packing mounting structure 100 according to the present embodiment, it is possible to suppress the shaft part 71 of the packing 7 from moving toward the insertion hole part 66 during fastening work.

The hole part 65 of the present embodiment is formed on the top wall part 63 that is a wall part along the axis direction X. The axis direction X is a direction along which the fastening force toward the counterpart device 200 is applied. The planar shape of the holding hole part 67 is an elongated hole the major-axis direction of which is the axis direction X. Therefore, the hole part 65 of the present embodiment allows the relative movement of the packing 7 along the direction in which the fastening force is applied, and can suitably suppress axial deviation between the packing 7 and the passage part 23.

In the packing 7 of the present embodiment, the seal part 80 is integrally molded with respect to the main body 70 serving as a portion to be held. Therefore, it is possible to reduce the size of the packing 7 and reduce the assembly work. For example, compared to when the main body 70 and the seal part 80 are separate components, the assembly work is reduced.

In the packing mounting structure 100 according to the present embodiment, as illustrated in FIG. 6, the packing 7 can move relative to the cover 6 in the height direction Z. More specifically, the size L1 of the gap between the first flange part 72 and the second flange part 73 is larger than the thickness t1 of the top wall part 63. Therefore, the packing mounting structure 100 according to the present, embodiment can absorb tolerance in the height direction Z by the cover 6 and the packing 7. Hence, in the packing mounting structure 100, the fastening direction of the fastening member may also be the height direction Z. For example, a fastening member that fixes the cover 6 to the casing 20 may apply a fastening force in the height direction Z.

Modification of Embodiment

A modification of the embodiment will now be described. The shape and arrangement of the hole part 65 are not limited to the shape and arrangement in the example. For example, the hole part 65 may be formed on a wall part other than the top wall part 63 of the cover 6. The planar shape of the insertion hole part 66 and the holding hole part 67 is not limited to circular, and may be formed in a curve-shape or a polygonal shape instead of circular. The extending direction of the narrow part 68 is not limited to the direction in the example. For example, the narrow part 68 may extend in the width direction Y.

The shape and configuration of the packing 7 are not limited to the shape and configuration in the example. For example, the shape of the seal part 80 is suitably set according to the shape of the passage part 23 to be closed. In the main body 70 of the packing 7, the shape and size of the first flange part 72 and the second flange part 73 are not limited to the shape and size in the example. For example, the diameter D1 of the first flange part 72 and the diameter of the second flange part 73 may be the same. The shape of the first flange part 72 and the second flange part 73 may be formed in a curve-shape or a polygonal shape instead of circular.

The contents disclosed in the embodiment and the modification described above may be combined with one another as appropriate.

The packing mounting structure according to the embodiment includes a casing that houses a power detection terminal, and that has a passage part for connecting the external space with the internal space on a wall part facing the power detection terminal; packing that has a seal part configured to close the passage part, and a portion to be held protruding toward the axis direction of the seal part from the seal part; a cover that has a hole part, that is installed on the casing in a state in which the portion to be held is held by the hole part, and that closes the passage part by the packing; and a fastening member that fastens the casing and the cover to a device serving as an object to which the casing and the cover are to be mounted.

The portion to be held includes a shaft part, a first flange part disposed on a tip end part of the shaft part, and a second flange part disposed on a position closer to the seal part in the shaft part. The hole part includes a narrow part having a narrower width than an outer diameter of the shaft part; an insertion hole part that is linked to one end of the narrow part, and that has a planar shape through which the first flange part is capable of passing, and a holding hole part that is linked to another end of the narrow part, that has a planar shape through which the first flange part is incapable of passing, and that holds the shaft part in a state in which a gap is formed between the holding hole part and the shaft part. With the packing mounting structure according to the embodiment, the holding hole part holds the shaft part in a state in which a gap is formed between the holding hole part and the shaft part. Because the gap absorbs the tolerance, it is possible to advantageously suppress axial deviation of the packing with respect to the passage part.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A packing mounting structure, comprising:

a casing that houses a power detection terminal, and that includes a passage part on a wall part facing the power detection terminal, the passage part connecting an external space with an internal space;

a packing that includes a seal part configured to close the passage part, and a portion to be held protruding toward an axis direction of the seal part from the seal part;

a cover that includes a hole part, that is installed on the casing in a state in which the portion to be held is held by the hole part, and that closes the passage part by the packing; and a fastening member that fastens the casing and the cover to a device serving as an object to which the casing and the cover are to be mounted, wherein the portion to be held includes a shaft part, a first flange part disposed on a tip end part of the shaft part, and a second flange part disposed on a position closer to the seal part in the shaft part, and the hole part includes a narrow part having a narrower width than an outer diameter of the shaft part;

an insertion hole part that is linked to one end of the narrow part, and that has a planar shape through which the first flange part is capable of passing; and a holding hole part that, is linked to another end of the narrow part, that has a planar shape through which the first flange part is incapable of passing, and that is configured to hold the shaft part in a state in which a gap is formed between the holding hole part and the shaft part.

2. The packing mounting structure according to claim 1, wherein the fastening member is a screw member that fastens together the cover and the casing to the device, the hole part is formed on a wall part along a fastening direction by the fastening member in the cover, and an extending direction of the narrow part is inclined with respect to the fastening direction by the fastening member.

3. The packing mounting structure according to claim 1, wherein the hole part is formed on a wall part along a direction of a fastening force in the cover, the fastening force being applied to the cover toward the device, and the planar shape of the holding hole part is an elongated hole a major-axis direction of which is the direction of the fastening force toward the device.

4. The packing mounting structure according to claim 2, wherein the hole part is formed on a wall part along a direction of a fastening force in the cover, the fastening force being applied to the cover toward the device, and the planar shape of the holding hole part is an elongated hole a major-axis direction of which is the direction of the fastening force toward the device.

5. The packing mounting structure according to claim 1, wherein the seal part is integrally molded with the portion to be held.

6. The packing mounting structure according to claim 2, wherein the seal part is integrally molded with the portion to be held.

7. The packing mounting structure according to claim 3, wherein the seal part is integrally molded with the portion to be held.

8. The packing mounting structure according to claim 4, wherein the seal part is integrally molded with the portion to be held.

* * * * *